US009863097B2

(12) United States Patent
Lintz

(10) Patent No.: US 9,863,097 B2
(45) Date of Patent: Jan. 9, 2018

(54) METHOD FOR CORRECTING A RAIL TRACK

(71) Applicant: PLASSER & THEURER EXPORT VON BAHNBAUMASCHINEN GESELLSCHAFT M.B.H., Vienna (AT)

(72) Inventor: Gerard Lintz, Bening-les-Saint-Avold (FR)

(73) Assignee: PLASSER & THEURER EXPORT VON BAHNBAUMASCHINEN GESELLSCHAFT M.B.H., Vienna (AT)

( * ) Notice: Subject to any disclaimer, the term of this patent is extended or adjusted under 35 U.S.C. 154(b) by 111 days.

(21) Appl. No.: 14/911,602

(22) PCT Filed: Aug. 14, 2014

(86) PCT No.: PCT/EP2014/002251
§ 371 (c)(1),
(2) Date: Feb. 11, 2016

(87) PCT Pub. No.: WO2015/036084
PCT Pub. Date: Mar. 19, 2015

(65) Prior Publication Data

US 2016/0186385 A1 Jun. 30, 2016

(30) Foreign Application Priority Data

Sep. 11, 2013 (AT) ..... A701/2013

(51) Int. Cl.
*E01B 35/00* (2006.01)
*E01B 27/02* (2006.01)
(Continued)

(52) U.S. Cl.
CPC ..... *E01B 35/00* (2013.01); *E01B 27/028* (2013.01); *E01B 27/06* (2013.01); *E01B 27/10* (2013.01); *E01B 33/00* (2013.01)

(58) Field of Classification Search
CPC ..... E01B 27/028; E01B 27/04; E01B 27/06; E01B 27/10; E01B 27/102; E01B 35/00; E01B 33/00
See application file for complete search history.

(56) References Cited

U.S. PATENT DOCUMENTS

2014/0297069 A1* 10/2014 Landes ..... E01B 27/02 701/19
2015/0025715 A1* 1/2015 Oberlechner ..... E01B 35/00 701/19

(Continued)

FOREIGN PATENT DOCUMENTS

EP 0 511 191 A2 10/1992
GB 2 186 309 A 8/1987
GB 2186309 A * 8/1987 ..... E01B 27/02

OTHER PUBLICATIONS

Track Machine Guidance, Rail Infrastructure, Issue No. 31, Jan.-Feb. 2003, pp. 47-49.

(Continued)

*Primary Examiner* — Jason C Smith
(74) *Attorney, Agent, or Firm* — Collard & Roe, P.C.

(57) ABSTRACT

For correction of a track position in connection with ballast cleaning, after cleaned ballast has been returned to a track, the actual position of the latter is measured while determining actual position data. Parallel to that, fixed point correction values are determined by a sighting trolley following behind. The actual position data and the fixed point correction values are transmitted to the tamping machine, follow- (Continued)

Figure 1:
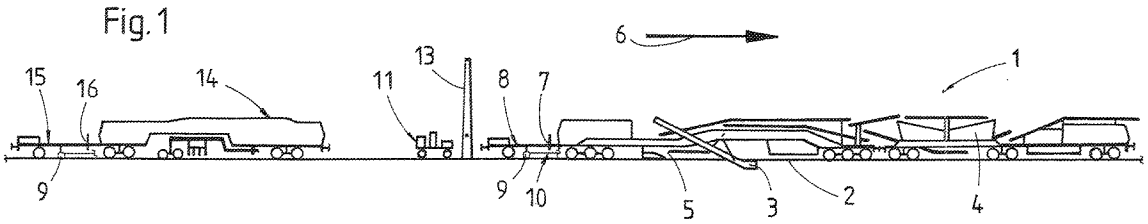

ing behind, and are used for determining correction values for a desired track position to be created by tamping.

2 Claims, 1 Drawing Sheet

(51) Int. Cl.

| | |
|---|---|
| ***E01B 27/10*** | (2006.01) |
| ***E01B 27/06*** | (2006.01) |
| ***E01B 33/00*** | (2006.01) |

(56) References Cited

U.S. PATENT DOCUMENTS

| | | | | |
|---|---|---|---|---|
| 2016/0186385 | A1* | 6/2016 | Lintz | E01B 27/028 104/10 |
| 2016/0273172 | A1* | 9/2016 | Van Cleave | G01B 11/272 |
| 2017/0159244 | A1* | 6/2017 | Lintz | E01B 27/13 |

OTHER PUBLICATIONS

International Search Report of PCT/EP2014/002251, dated Nov. 4, 2014.

* cited by examiner

METHOD FOR CORRECTING A RAIL TRACK

CROSS REFERENCE TO RELATED APPLICATIONS

This application is the National Stage of PCT/EP2014/002251 filed on Aug. 14, 2014, which claims priority under 35 U.S.C. §119 of Austrian Application No. A701/2013 filed on Sep. 11, 2013, the disclosures of which are incorporated by reference. The international application under PCT article 21(2) was not published in English.

The invention relates to a method for correction of a track position in connection with ballast cleaning by means of a cleaning machine which precedes a tamping machine with regard to a working direction.

A combination of ballast cleaning of a track with an immediately following track position correction by a tamping machine is known according to GB 2 186 309.

In the article "Track machine guidance" in the technical journal "Rail Infrastructure", 31 (2003), pages 47 to 49, a method for measurement of the track position is described in more detail. A measuring vehicle, stationary during the track measuring process and equipped with a laser transmitter, is moved in the working direction up to a succeeding, geodetically surveyed fixed point which usually is located on a catenary mast. The laser transmitter is set up with respect to the fixed point adjoining in the transverse direction of the track and is thus brought into an exact desired position. Subsequently, the laser transmitter—with the aid of a telescope mounted on the same—is aimed at the receiver located on the mobile, rear measuring vehicle.

It is the object of the present invention to provide a method of the type mentioned at the beginning with which an improved track position correction is possible.

According to the invention, this object is achieved with a method of the specified kind by way of the features cited in the characterizing part of the main claim.

With this method it is possible to reduce the total length of the track construction site, while avoiding a measuring run which is limited to merely measuring the track position.

Additional advantages of the invention become apparent from the dependent claim and the drawing description.

Figure 2:
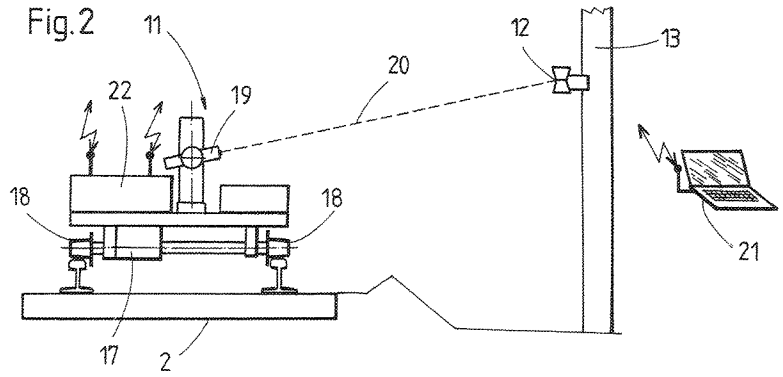

The invention will be described in more detail below with reference to an embodiment represented in the drawing in which FIG. 1 shows a side view of a cleaning machine for cleaning ballast of a track and, following behind, a tamping machine for a track position correction, and FIG. 2 shows an enlarged view, in the longitudinal direction of the track, of a sighting trolley.

On a track construction site shown in FIG. 1, a cleaning machine 1 for cleaning ballast of a track 2 is provided. This machine is essentially composed of a clearing chain 3 for picking up ballast, and a screening plant 4. The cleaned ballast is discharged upon the track 2 via a discharge point 5. Provided at a rear end 7—with respect to a working direction 6—of the cleaning machine 1 is a measuring trailer 8. Said trailer has a track measuring system 10 which is formed of measuring axles 9 and a measuring chord.

Immediately following the cleaning machine 1, a sighting trolley 11—shown on a larger scale in FIG. 2—for distance measurement to a fixed point 12 is provided, the latter being fastened to a catenary mast 13.

Following the sighting trolley 11, a tamping machine 14 with a measuring trailer 15 is provided. The latter is articulatedly connected to a rear machine end 16 and also equipped with measuring axles 9, designed to roll on the track 2, and with a measuring chord.

The sighting trolley 11 visible in FIG. 2 is mobile on the track 2 by means of a drive 17 and wheels 18 and is already known from EP 0 511 191. With the aid of a laser transmitter 19 and a laser beam 20, the position of the track 2 with respect to the fixed point 12 can be calculated in a computer 22. The sighting trolley 11 can be controlled with the aid of a remote control unit 21 by an operator situated adjacent to the track 2.

The method according to the invention will now be described in more detail. While ballast is cleaned continuously by means of the first vehicle, i.e. the cleaning machine 1, a track position correction takes place, also continuously, by means of the tamping machine 14 following behind.

After the cleaned ballast has been returned to the track 2, the actual position of the latter is measured while recording actual position data by means of the measuring trailer 8. Parallel to that, fixed point correction values are determined immediately behind the cleaning machine 1 by the sighting trolley 11 in that the present track position or actual position with respect to fixed points 12 is detected. The actual position data and the fixed point correction values are transmitted by radio to the tamping machine 1, following behind, and used in connection with a software program for determining correction values for a desired track position to be created by tamping.

In a further variant of the invention, it is possible to employ an additional tamping machine immediately behind the tamping machine 14 shown in FIG. 1. In this case, further actual position data of the track 2 which are measured by the measuring trailer 15 of the preceding first tamping machine 14 are transmitted by radio to the tamping machine following behind in order to calculate the required track correction values.

The invention claimed is:

1. The method for correction of a track position in connection with ballast cleaning by means of a cleaning machine which precedes a tamping machine with regard to a working direction, comprising the following steps:

a) after cleaned ballast has been returned to a track, the actual position of the track is measured while determining actual position data of the track, b) parallel in time to step a), determining fixed point correction values in that the track position with respect to fixed points is detected, c) transmitting the actual position data of the track and the fixed point correction values to the tamping machine, which is following behind, wherein the position data and the correction values are used for determining correction values for a desired track position to be created by tamping.

2. The method according to claim 1, wherein, immediately after a first tamping of the track by the said tamping machine, both actual position data of the track as well as fixed point correction values are detected again and used by a following second tamping machine for determining new correction values for a desired track position.

* * * * *